US006792216B2

(12) United States Patent
Wachter et al.

(10) Patent No.: US 6,792,216 B2
(45) Date of Patent: Sep. 14, 2004

(54) SYSTEM FOR ESTIMATING THE REMAINING LIFE OF A PRINT CARTRIDGE

(75) Inventors: Roman T. Wachter, Boise, ID (US); Jeetendra Kumar, Boise, ID (US); Nataraj Kumar Gobbak, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 4 days.

(21) Appl. No.: 10/325,158

(22) Filed: Dec. 19, 2002

(65) Prior Publication Data

US 2004/0120725 A1 Jun. 24, 2004

(51) Int. Cl.[7] ..... G03G 15/00; G03G 15/08
(52) U.S. Cl. ..... 399/8; 399/27
(58) Field of Search ..... 399/8, 12, 13, 399/27, 53, 61; 347/7, 19

(56) References Cited

U.S. PATENT DOCUMENTS

| | | | | |
|---|---|---|---|---|
| 5,794,094 A | * | 8/1998 | Boockholdt et al. | 399/27 |
| 6,456,802 B1 | | 9/2002 | Phillips | 399/27 |
| 6,510,292 B1 | * | 1/2003 | Owen et al. | 399/27 |
| 6,584,291 B1 | * | 6/2003 | Yamamoto | 399/27 |

* cited by examiner

*Primary Examiner*—William J. Royer
(74) *Attorney, Agent, or Firm*—Matthew L. Wade

(57) ABSTRACT

A printing system is described. The printing system includes a printer capable of utilizing print material contained by a cartridge. The printer is capable of detecting when the level of the print material is at a different one of a plurality of pre-determined levels. The printer is also capable of counting pixels. The printer can periodically estimate the remaining life of the cartridge using a reference print material level and the change in pixel count since the print material was at the reference material level.

25 Claims, 7 Drawing Sheets

SYSTEM FOR ESTIMATING THE REMAINING LIFE OF A PRINT CARTRIDGE

BACKGROUND

Many printing devices make use of a replaceable print cartridge. The cartridge typically contains a print material (e.g., toner or ink) that is consumed during a printing operation.

There have been efforts in the past to develop systems that monitor the remaining life of a print cartridge in a printing device. Ways are needed, however, to improve these systems.

It is noted for the later discussion that the "remaining life" of a print cartridge refers to the present capacity of the cartridge to print additional pages. One way, for example, the remaining life of a cartridge may be expressed is as a percentage of the original capacity.

For example, if none of the original amount of print material in a cartridge has been consumed, the remaining life of the cartridge may be said to be at "100%". If 50% of the original print material is consumed, the remaining life of the cartridge may be said to be at "50%".

DESCRIPTION

Figure 1:
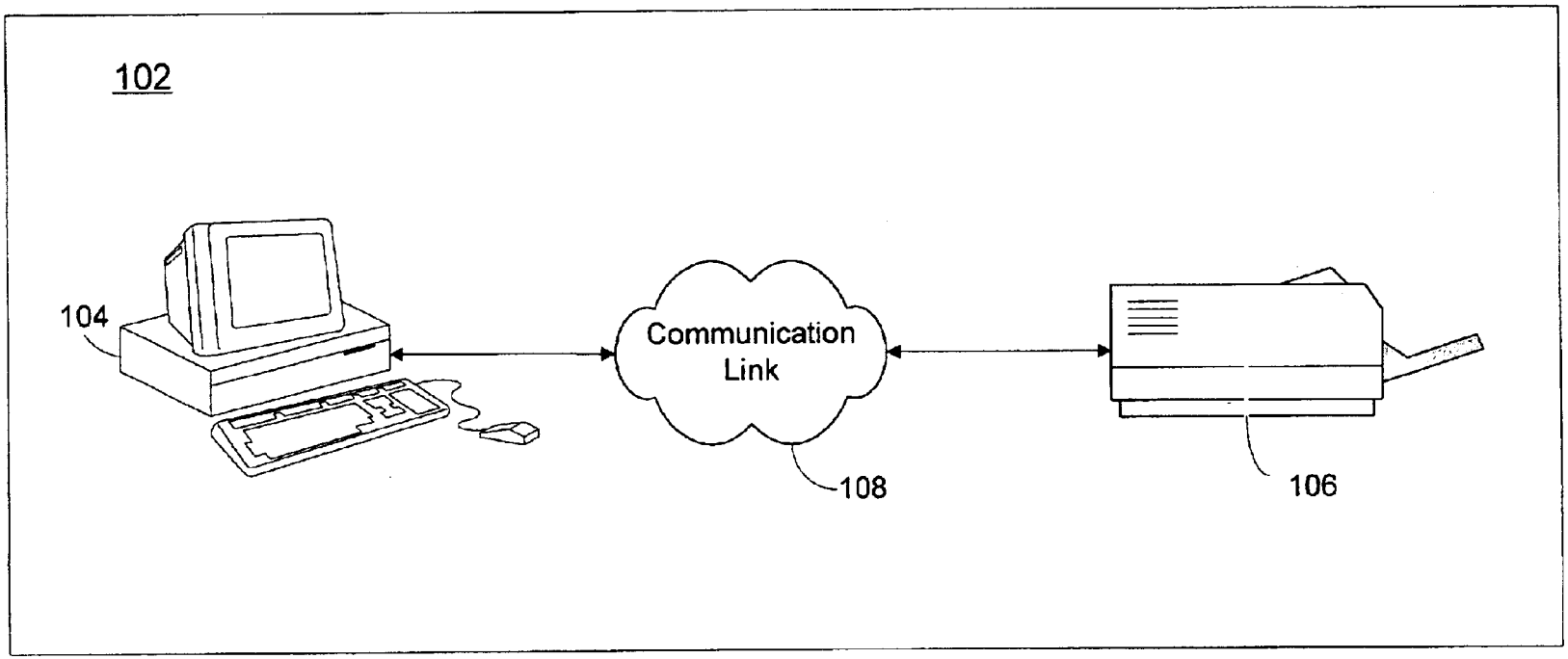
FIG. 1 illustrates a computing system.

Referring to FIG. 1, a computing system 102 is shown. The computing system 102 includes a computer 104 and a printer 106. The computer 104 is connected to the printer 106 by a communication link 108.

The computer 104 may represent any type of computer that is capable of transmitting a print job to the printer 106 over the communication link 108. Thus, for example, the computer 104 may represent a personal computer, a laptop computer, a personal digital assistant (PDA), and the like.

The printer 106 may represent any type of printing device. For example, the printer 106 may represent an ink printer or an electrophotographic (EP) printer. It is further noted that the printer 106 may represent a multifunctional device. For example, the printer 106 may permit a walk-up user to print copies of a hardcopy document and/or transmit a fax.

The communication link 108 may represent any type of communication system that enables the computer 104 to transmit electronic information to the printer 106. Thus, for example, the communication link 108 may represent a wired and/or a wireless type communication system. In some implementations, for example, the communication link 108 may represent an intranet and/or the Public Internet. In other implementations, for example, the communication link 108 may represent a cable that directly connects the two devices.

Figure 2:
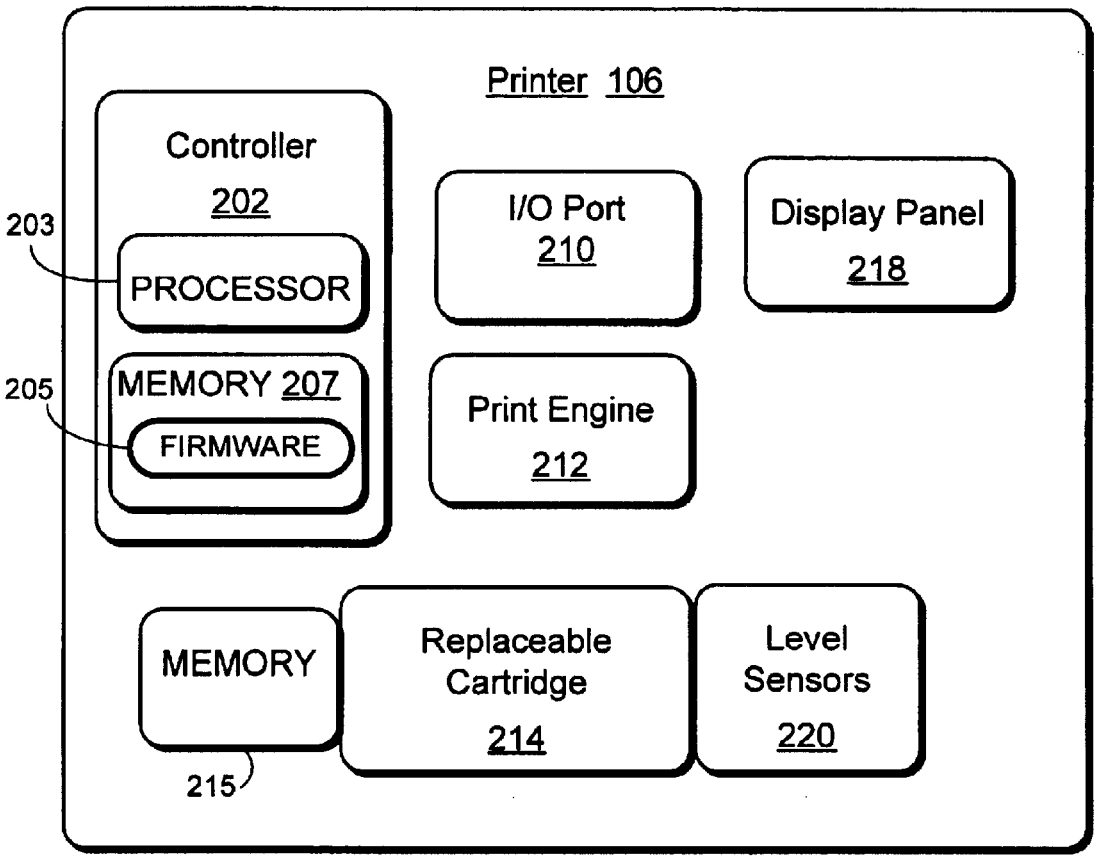
FIG. 2 is a high-level block diagram of a printer.

FIG. 2 is a high-level block diagram of the printer 106. The printer 106, in this example, includes the following: a controller 202, an Input-Output (I/O) port 210, a print engine 212, a replaceable cartridge 214, a display panel 25 218 and a set of level sensors 220. The printer 106 may include other components that are not shown. For example, the printer 106 may include additional replaceable cartridges, a local control panel, a hard drive, a scanning device, and the like.

The controller 202 orchestrates the operation of the printer 106. As shown, the controller 202 includes, in this example, a processor 203 and a firmware module 205. Aspects of the controller 202 operation are typically performed by the processor 203 while executing the firmware module 205. The firmware module 203 is stored in a local memory 207.

The I/O port 210 enables the printer 106 to both receive data (e.g., print job data) and to transmit data over the communication link 108.

The print engine 212 includes the appropriate hardware to enable the printer 106 to print images on media. As indicated above, in some implementations, the print engine 212 may represent an EP print engine. In other implementations, for example, the print engine 212 may represent an ink print engine. It is noted that the print engine 212 may be capable of printing on any number of media types. Including, for example, opaque and/or transparent media. Also, in some implementations, the media may be in the form of paper sheets, paper rolls, plastic sheets (such as overhead transparencies), vellum sheets, envelopes, cardstock or the like. It is further noted that the print engine 212 may enable the printer 106 to print images in color and/or in monochrome.

The replaceable cartridge 214 contains a print material that is utilized by the print engine 212 to print. The print material may be, for example, toner or ink. In this example, the cartridge 214 includes an integrated memory component 215 that is used to store certain electronic data. The memory component 215, in this example, is both readable and writeable by the printer 106.

The level sensors 220 may include any type of sensor that can sense when the print material of the cartridge 214 is at a particular level. Thus, for example, the level sensors 220 may represent optic sensors and/or capacitance sensors. The level sensors 220 may also be an integrated part of the cartridge 214.

Figure 3:
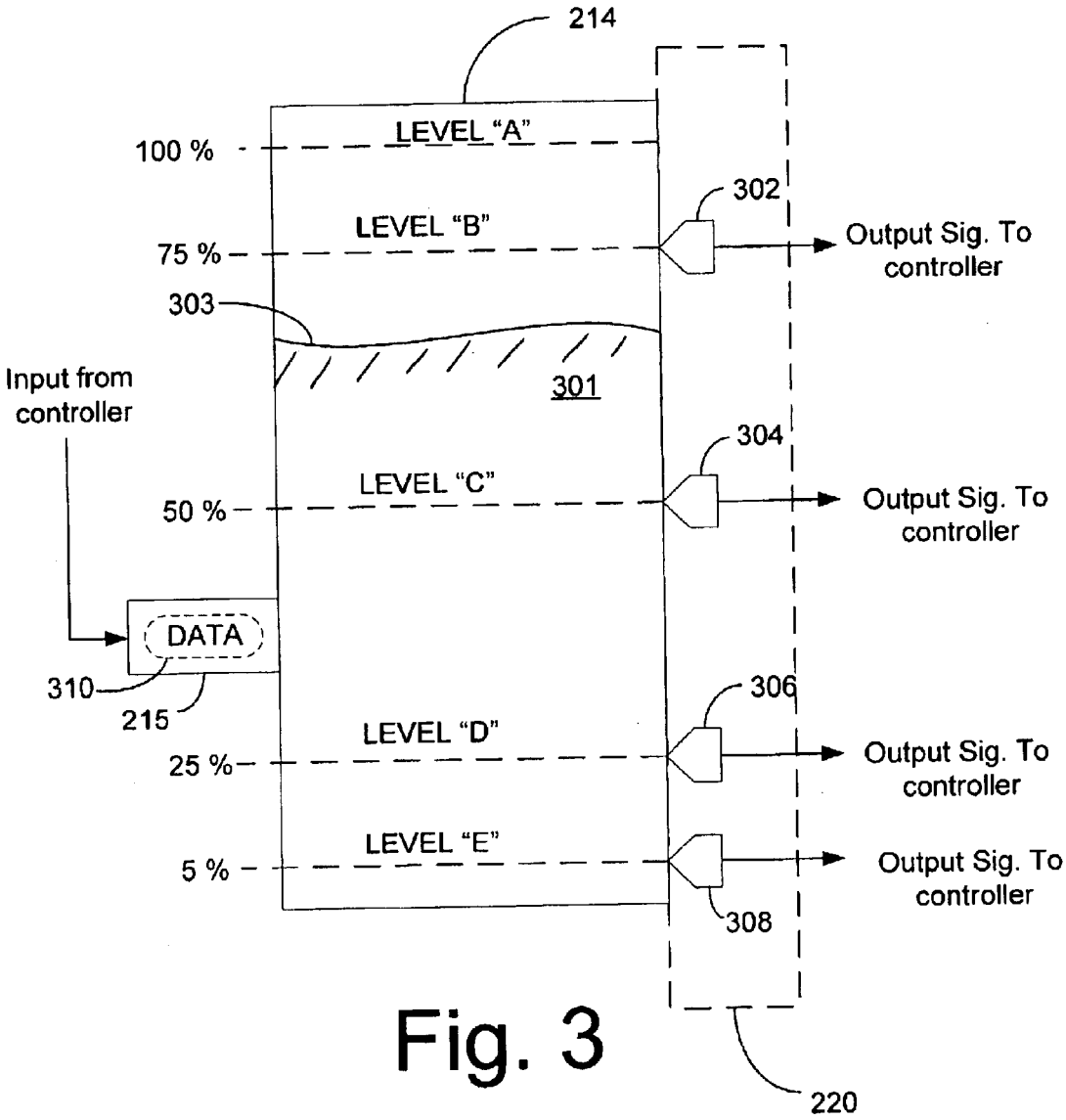
FIG. 3 illustrates, schematically, a replaceable print cartridge.

FIG. 3 illustrates, schematically, each one of the level sensors 220 and the replaceable cartridge 214. The print material 301 contained by the cartridge 214 is also represented.

It is noted that FIG. 3 illustrates five pre-determined print material levels: Level "A","B","C", "D" and "E". Level "A" represents the level of the print material 301 when the cartridge 214 is considered to be at 100% capacity. It noted that Level "A" may be the expected print material level prior to the cartridge 214 being used.

In this example, the level sensors 220 include four discrete sensors: a first level sensor 302, a second level sensor 304, a third level sensor 306 and a fourth level sensor 308. Each of these four sensors are configured and adapted to generate a signal when the level of the print material 303 moves to one of the pre-determined levels. The controller 202 is configured to monitor the level sensors for these signals.

The first level sensor 302, for example, generates a signal when the print material level is at level "B". It has been determined that when the print material 301 is at level B, approximately 25% of the print material 301 has been consumed. Thus, when the first level sensor 302 generates a signal, the remaining life of the cartridge 214 is at approximately "75%". That is to say, 75% of the print material 301 originally contained by the cartridge 214 remains.

The second level sensor 304 generates a signal when the print material level is at level "C". It has been determined that when the print material 301 is at level C, approximately 50% of the print material 301 has been consumed. Thus, when the second level sensor 304 generates a signal this indicates that the remaining life of the cartridge 214 is at approximately "50%".

The third level sensor 306 generates a signal when the print material level is at level "D". It has been determined that when the print material 301 is at level "D", approximately 75% of the print material 301 has been consumed. Thus, when the third level sensor 306 generates a signal this indicates that the remaining life of the cartridge 214 is at approximately "25%".

The fourth level sensor 308 generates a signal when the print material level is at level "E". It has been determined that when the print material 301 is at level E, approximately 95% of the print material 301 has been consumed. Thus, when the fourth level sensor 308 generates a signal this indicates that the remaining life of the cartridge 214 is at approximately "5%".

Also shown in FIG. 3 is the cartridge memory component 215. As indicated above, in this implementation, the memory component 215 is an integrated component of the replaceable cartridge 214. Stored in the memory component 215 is data 310. In some implementations, the data 310 may indicate an estimate of the remaining life of the cartridge 214. How the printer 106 may calculate this estimate is discussed below.

As previously noted, the printer 106 is able to receive and process print jobs. During the processing of these jobs, the print material 301 contained by the cartridge 214 is typically consumed.

Figure 4A:
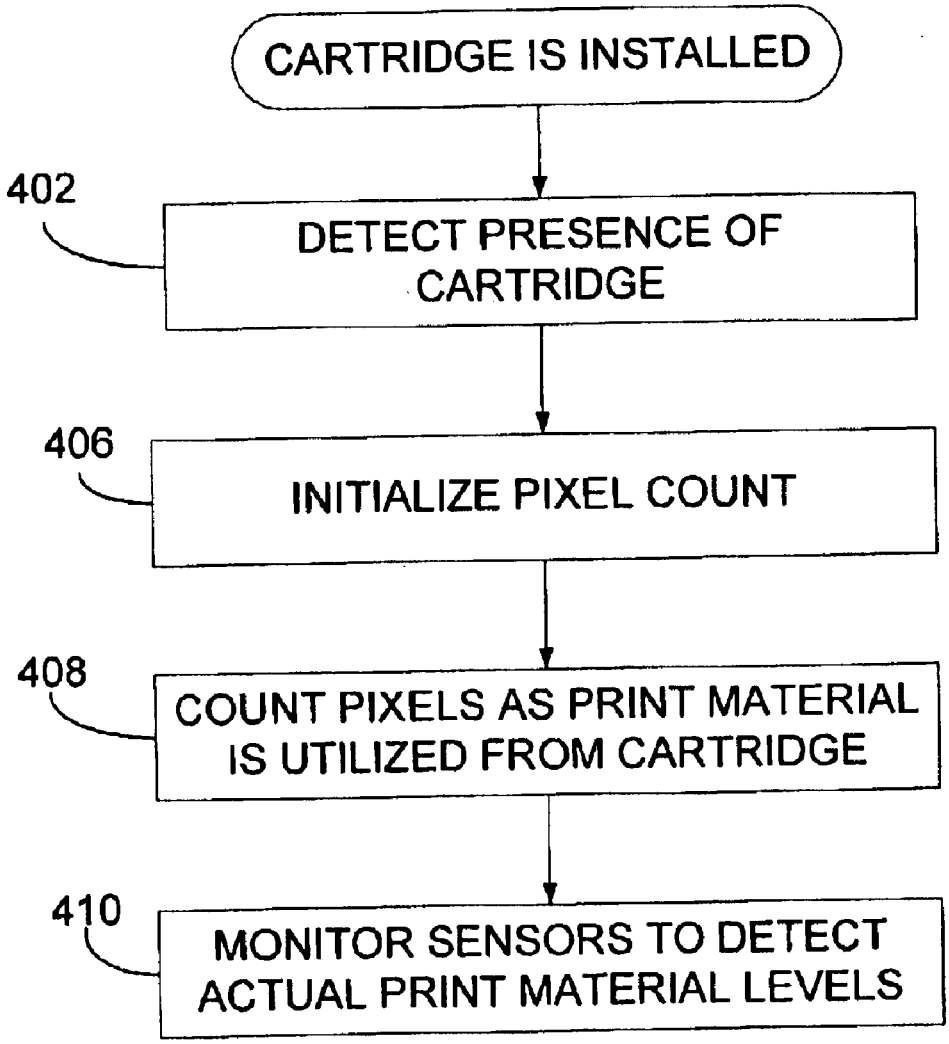
FIG. 4A is a flow diagram illustrating, by way of example, certain aspects of the printer operation.

FIG. 4A is a flow diagram illustrating, by way of example, certain aspects of the printer operation. Referring to FIG. 4A, the cartridge 214 is first installed into the printer 106. The printer 106 detects the presence of the 35 cartridge 214 (step 402). In response, the printer 106 operates to initialize a pixel count for the cartridge 214 (step 406).

Thereafter, until the cartridge 214 is removed, the printer 106 operates to count pixels (as jobs are processed) that are generated which utilize print material 301 from the cartridge 214 (step 408).

Additionally, the printer 106 operates to monitor the level sensors 220 in order to detect an actual print material level (step 410). That is to say, the printer 106 monitors the level sensors 220 to detect when the print material 301 is at level "B", "C", "D" and "E".

It is also noted that once the cartridge 214 is installed, the printer 106 periodically estimates the remaining life of the cartridge 214. In this example, the printer 106 calculates these estimates using a pre-determined function that relates the present remaining life of the cartridge 214 to the following values:

a) a reference print material level; and b) the change in the pixel count since the print material 301 was at the reference level.

It is noted the reference print material level may be any past print material level. It is further noted that the reference level may be an assumed level or a detected level.

As is discussed in greater detail below, the printer 106 may use different reference levels during the life span of the cartridge 214 to estimate the remaining life of the cartridge 214. For ease of the following discussion, the reference level presently being used, at any point in time, to estimate the remaining life of the cartridge 214 may be referred to as the "current reference level".

Figure 4B:
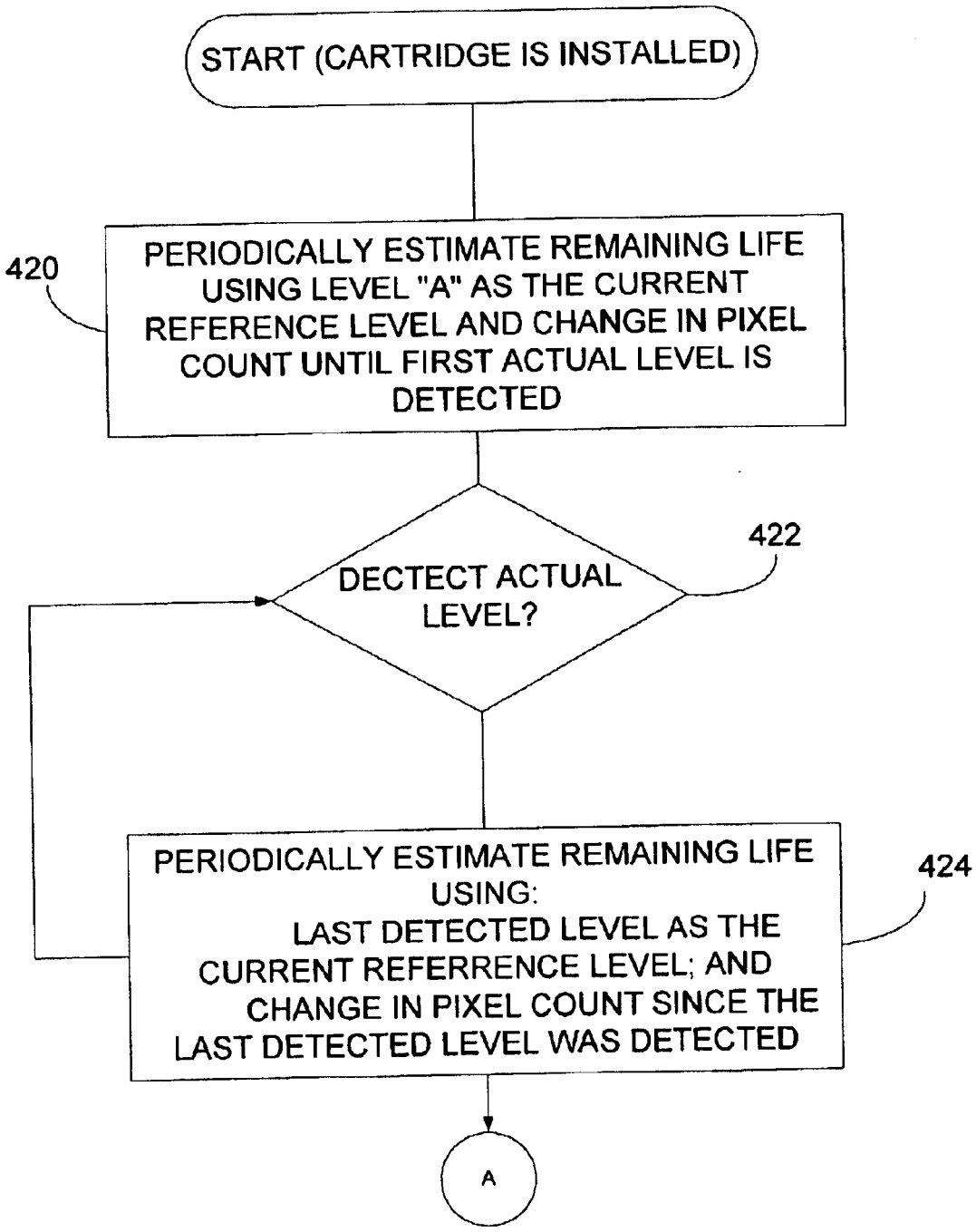
FIG. 4B illustrates how the printer may operate to periodically estimate the remaining life of the cartridge.

FIG. 4B illustrates how the printer 106 may operate to estimate the remaining life of the cartridge 214. Referring to FIG. 4B, after the cartridge 214 is installed in the printer 106, the printer 106 begins to periodically estimate the remaining life of the cartridge 214 (step 420).

In this example, an assumption is made that when the cartridge 214 is first installed, level "A" is the present print material level. Thus, prior to a signal being generated, the printer 106 calculates each remaining life estimate using the following values:(a) level "A" as the current reference level; and (b) the change in the pixel count since the cartridge 214 was first installed.

When the printer 106 detects an actual print material level (i.e., when one of the four level sensors 220 generates a signal) (step 422), the printer 106 then proceeds to calculate each remaining life estimate using: (a) the last detected level as the current reference level; and (b) the number of pixels counted since the last detected level was detected (step 424).

Figure 5:
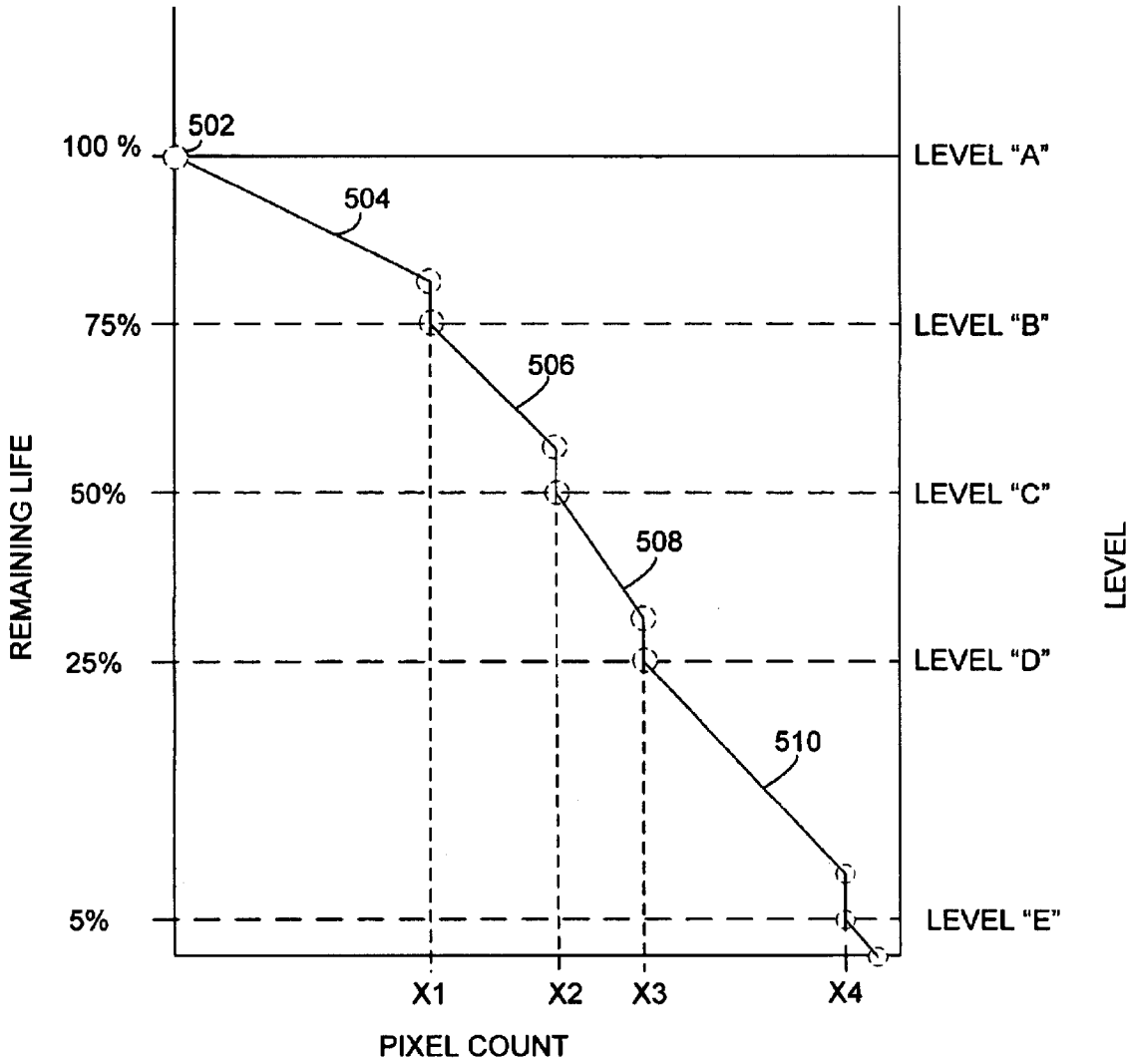
FIG. 5 is a graph for illustrating further, by way of example, the operation of the printer to periodically estimate the remaining life of the cartridge.

FIG. 5 is a graph 502 for illustrating further, by way of example, the operation of the printer 106 to periodically estimate the remaining life of the cartidge 214. The "X" axis of the paragraph 502 represents the pixels counted at step 408 during the life of the cartridge 214. The first "Y" axis represents the remaining life estimates. The second Y-axis represents the corresponding print material level.

In this example, the following scenario is assumed:

a) The print material 301 is at level "A" when the cartridge 214 is first installed into the printer 106;

b) The first level sensor 302 generates a signal when the cartridge pixel count value reaches a value of "XI";

c) The second level sensor 304 generates a signal when the 20 cartridge pixel count value reaches a pixel count value of "X2";

d) The third level sensor 306 generates a signal when the cartridge pixel count reaches a pixel count value of "X3"; and e) The fourth level sensor 308 generates a signal when the cartridge pixel count reaches a pixel count value of "X4".

Referring now to FIG. 5, after the cartridge 214 is installed and until an actual level is detected, the printer 106 operates to periodically estimate the remaining life of the cartridge 214 using level "A" as the current reference level. The first curve 504 illustrates the relationship between the pixel count and the remaining life estimates until the first actual level is detected.

At pixel count "X1", the printer 106 detects that the actual print material level is presently at "level B". Thereafter, until the next actual print material level is detected, the printer 106 periodically estimates the remaining life using level "B" as the current reference level. The second curve 506 illustrates the relationship between the pixel count and the remaining life estimates until the next actual level is detected.

At pixel count "X2", the printer 106 detects that the actual print material level is presently at "level "C". Thereafter, until the next actual print material level is detected, the printer 106 periodically estimates the remaining life using level "C" as the current reference level. The third curve 508 illustrates the relationship between the pixel count and the remaining life estimates until the next actual level is detected.

At pixel count "X3", the printer 106 detects that the actual print material level is presently at "level "D". Thereafter, until the next actual print material level is detected, the printer 106 periodically estimates the remaining life using level "D" as the current reference level. The fourth curve 510 illustrates the relationship between the pixel count and the remaining life estimates until the next actual level (level E) is detected.

It is noted that in some implementations, the cartridge memory component 215 may include data (e.g., data 310) that indicates the present remaining life of the cartridge 214. When the cartridge 214 is first installed, the printer 106 may read this information and initially use this information to determine the initial current reference level. This current reference level may then be used to estimate the remaining life of the cartridge 214 until an actual level is detected. Also, in operation, the printer 106 may periodically update the data in the cartridge memory component 215 to indicate the present remaining life of the cartridge 214. If the cartridge 214 is removed and then placed into another printer (printer "B"), printer "B" may then read and use this information to determine the present remaining life of the cartridge 214. Printer "B" may also use this information in a similar manner as printer 106. That is to say, printer "B" may use this information to set an initial current reference level and then proceed to periodically estimate the remaining life of the cartridge 214.

Figure 6:
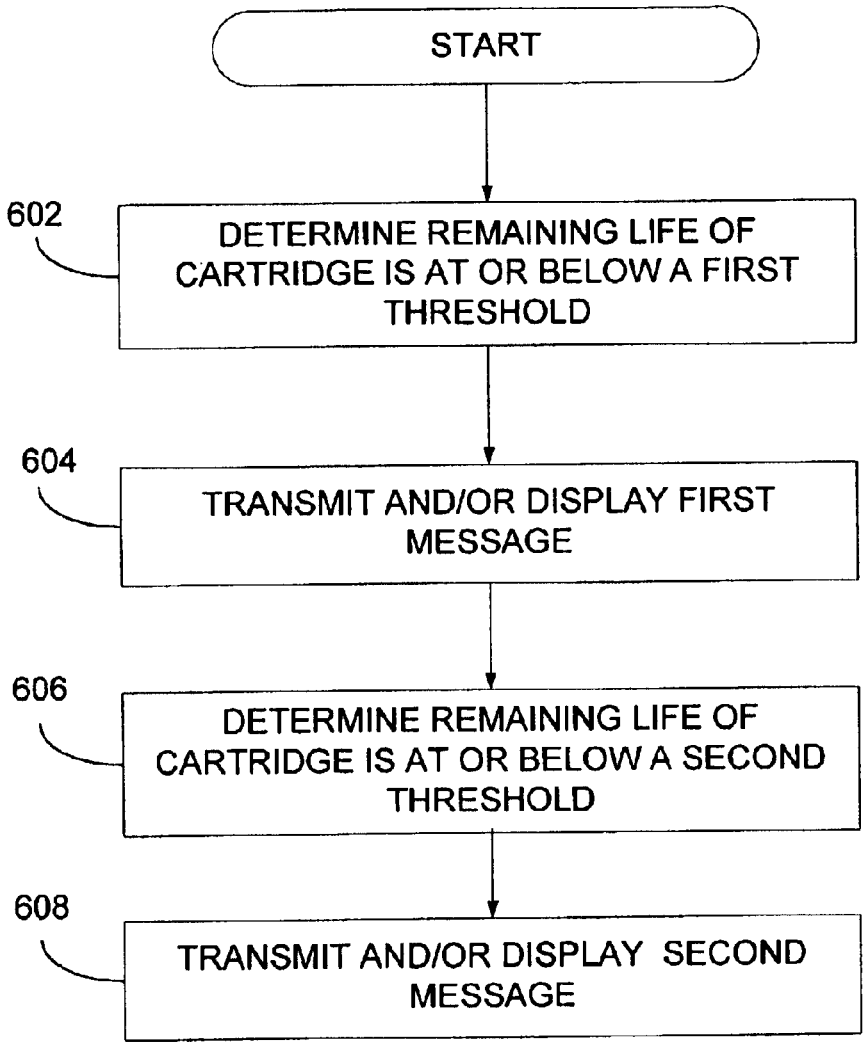
FIG. 6 is a flow chart illustrating an aspect of the printer operation.

FIG. 6 is a flow chart illustrating an additional aspect of the printer 106 operation. Referring to FIG. 6, the printer 106 operates to detect when the estimated remaining cartridge life is below a "reorder" threshold (step 602). It has been determined that when the cartridge life moves below this threshold, a new cartridge should be ordered. In response to this condition, the printer 106 operates to transmit a message that indicates the present remaining life estimate of the cartridge 214 (step 604).

The message may, for example, be transmitted to the computer 104 (see FIG. 1) or sent to a particular e-mail account. The message may include information to facilitate the re-order of the cartridge 214. For example, the message may indicate a part number of the cartridge 214. The message may also include a hyperlink to a WEB based server system that enables online ordering of the cartridge 214.

It is noted that the reorder threshold may be based in part upon the rate at which the cartridge 214 is being depleted. In some implementations, for example, the controller 202 operates to track the life estimates over time in order to determine the depletion rate of the print material 301. If the depletion rate is above a first threshold, the controller 202 sets the "reorder threshold" to a relatively high value. If, however, the depletion rate is below a second threshold, the "reorder threshold" is set to a relatively low value.

At step 606, the printer 106 operates to detect that the remaining life of the cartridge 214 is below 5%. In response, a message may be displayed on the display panel 218 indicating this condition (step 608).

It is further noted that the present invention may be embodied in the form of a "computer-readable medium". As used herein, the phrase "computer-readable medium" can refer to any medium that can contain, store or propagate computer executable instructions. Thus, in this document, the phrase "computer-readable medium" may refer to a medium such as an optical storage device (e.g., a CD ROM) or a magnetic storage device (e.g., a magnetic tape). The phrase "computer-readable medium" may also refer to signals that are used to propagate the computer executable instructions over a network or a network system, such as the Public Internet.

Thus, a memory component (e.g., memory 207) that stores computer executable instructions (e.g., firmware 205) may represent an embodiment of the invention. Furthermore, signals used to propagate the firmware 205 over a communication link 108 (e.g. an intranet, Public Internet, etc) may also represent an embodiment of the invention.

Although several specific embodiments of the invention have been described and illustrated, the invention is not to be limited to specific forms or arrangements of parts so described and illustrated. The invention is limited only by the claims and the equivalents thereof.

What is claimed is:

1. In a printer, a method of estimating the remaining life of a print cartridge containing a print material, comprising:

(a) determining an actual level of print material in the cartridge each time a signal is generated by one of a plurality of print material level sensors, where each sensor is configured to generate a signal when the print material is at a different one of a plurality of pre-determined levels;

(b) counting pixels that are printed utilizing print material from the cartridge; and (c) periodically estimating the remaining life of the cartridge based upon the actual level determined the last time step (a) was performed and the number of pixels counted since the last time step (a) was performed.

2. The method of claim 1, wherein the print material is toner or ink.

3. The method of claim 1, further comprising:

(d) periodically storing the present estimate of the remaining life of the cartridge in a memory located on the cartridge.

4. The method of claim 1, further comprising:

(d) determining that the present estimate of the remaining life of the cartridge is below a first threshold;

(e) in response to step (d), transmitting a message; and wherein the message indicates that a replacement cartridge should be ordered.

5. A printer capable of utilizing a print material contained by a print cartridge to print, the printer comprising:

(a) means for detecting when the level of print material is at each of a plurality of different predetermined levels;

(b) means for counting pixels; and (c) means for periodically estimating the remaining life of the cartridge using the last pre-determined level detected and by using the number of pixels counted since the last pre-determined level was detected; and wherein the estimating means operates to periodically estimate the remaining life of the cartridge throughout the life of the cartridge.

6. The printer of claim 5, further comprising:

(d) means for printing print jobs; and (e) wherein the pixel counting means operates to count those pixels that are printed utilizing print material from the cartridge.

7. The printer of claim 5, wherein the cartridge includes an integrated memory and the printer further comprises:

(d) means for periodically writing data to the memory; and (e) wherein the data describes the present estimate of the remaining life of the cartridge.

8. The printer of claim 5, further comprising:

(d) means for transmitting a message to a pre-determined destination when the present estimate moves below a threshold; and (e) wherein the message indicates that a replacement for the cartridge should be ordered.

9. The printer of claim 5, further comprising:

(d) means for transmitting an e-mail message to a pre-determined destination;

(e) wherein the message includes a hyperlink to a particular WEB site; and (f) wherein the WEB site enables a user to place a new order for the cartridge.

10. A computer implemented control system for a printer, the printer capable of utilizing print material contained by a cartridge, the system comprising:

circuitry to receive signals generated by a plurality of level sensors each for detecting when the level of the print material is at a different one of a plurality of pre-determined levels;

processing circuitry, coupled to the system, configured to:

(a) count pixels as print jobs are processed;

(b) monitor the sensors over the life of the cartridge in order to detect when the print material is at each one of the pre-determined levels; and (c) periodically estimate the remaining life of the cartridge based upon the last detected print material level and the number of pixels counted since the last print material level was detected.

11. The system of claim 10, wherein the processing circuitry is further configured to:

(d) transmit a first warning when the estimated remaining life moves below a first threshold; and (e) transmit a second warning if the estimated remaining life moves below a second threshold.

12. The system of claim 10, wherein the processing circuitry is further configured to:

(d) cause an e-mail to be transmitted when the estimated remaining life moves below a first threshold; and (e) cause a message to be displayed if the estimated remaining life moves below a second threshold;

wherein the first e-mail indicates that the cartridge will soon need to be replaced;

wherein the message indicates that the cartridge should now be replaced.

13. The system of claim 10, wherein the cartridge includes an integrated memory component and the processing circuitry is further configured to periodically write the present estimate of the remaining life of the cartridge to the memory.

14. A printer, comprising:

a print engine for printing print jobs; and processing circuitry, coupled to the print engine;

wherein the print engine utilizes print material contained by a replaceable print cartridge to print;

wherein the cartridge includes a plurality of level sensors each configured to generate a signal when the level of print material moves to a unique one of a plurality of pre-determined levels; and wherein the processing circuitry is configured to:

(a) count pixels;

(b) monitor the sensors over the life of the cartridge in order to detect when the print material is at each one of the pre-determined levels; and (c) repeatedly estimate the remaining life of the cartridge using the last detected print material level and the number of pixels counted since the last print material level was detected.

15. The printer of claim 14, wherein the cartridge is a toner cartridge.

16. The printer of claim 14, wherein the cartridge is an ink cartridge.

17. The printer of claim 14, wherein the printer is capable of printing in color.

18. The printer of claim 14, wherein the processing circuitry counts those pixels that are generated from the cartridge.

19. The printer of claim 14, wherein the cartridge includes an integrated memory and the processing circuitry is configured to periodically write data to the memory;

wherein the data describes the present estimate of the remaining life.

20. In a printer, a method of periodically estimating the present capacity of a print cartridge to print additional pages, comprising:

(a) detecting a plurality of actual print material levels;

(b) counting pixels;

(c) estimating the present capacity of the cartridge to print additional pages;

wherein step (c) is performed based upon the last actual level detected and the number of pixels counted since the last actual level was detected.

21. The method of claim 20, wherein step (c) is performed multiple times after step (a) is first performed.

22. The method of claim 20, wherein the cartridge includes a memory component and the method further includes periodically storing the present estimate in the memory.

23. In a printer, a method comprising:

detecting the presence of a new print cartridge, where the cartridge includes a memory that stores an initial level value of print material contained by the cartridge;

in response to detecting the presence of the cartridge, reading the initial level value from the memory;

counting pixels as pages are printed by the printer;

periodically estimating, until an actual print material level is detected, the remaining life of the cartridge using the initial level value and the number of pixels counted since the presence of the cartridge was detected;

detecting a plurality of actual print material levels; and periodically estimating the remaining life of the cartridge based upon the last actual level detected and the number of pixels counted since the last actual level was detected.

24. The method of claim 23, further comprising:

periodically storing the present estimate of the remaining life of the cartridge in the memory.

25. The method of claim 23, further comprising:

transmitting a message when the estimated remaining life falls below a first threshold;

wherein the message indicates that a replacement cartridge should be ordered.

* * * * *

UNITED STATES PATENT AND TRADEMARK OFFICE

CERTIFICATE OF CORRECTION

PATENT NO. : 6,792,216 B2
DATED : September 14, 2004
INVENTOR(S) : Roman T. Wachter et al.

It is certified that error appears in the above-identified patent and that said Letters Patent is hereby corrected as shown below:

Column 4,
Line 25, after "detected" delete "(step 424)."
Line 29, delete "paragraph" and insert therefor -- graph --

Column 5,
Line 60, after "condition" delete "(step 608)."

Signed and Sealed this

Third Day of May, 2005

JON W. DUDAS
*Director of the United States Patent and Trademark Office*